United States Patent [19]

Hoellerich

[11] 4,122,749

[45] Oct. 31, 1978

[54] MARCHING TIMPANI

[75] Inventor: John L. Hoellerich, Northbrook, Ill.

[73] Assignee: Slingerland Drum Co., Niles, Ill.

[21] Appl. No.: 773,508

[22] Filed: Mar. 2, 1977

[51] Int. Cl.[2] ..... G10D 13/04
[52] U.S. Cl. ..... 84/419
[58] Field of Search ..... 84/411 R, 411 A, 419

[56] References Cited

U.S. PATENT DOCUMENTS

| | | | |
|---|---|---|---|
| 2,074,193 | 3/1937 | Strupe | 84/411 A |
| 2,150,981 | 3/1939 | Ludwig | 84/419 |
| 3,186,289 | 6/1965 | Kester | 84/411 R |

*Primary Examiner*—John Gonzales
*Attorney, Agent, or Firm*—Wegner, Stellman, McCord, Wiles & Wood

[57] ABSTRACT

A machine-tuning marching timpani having an adjusting apparatus arranged in a thin, generally planar configuration permitting the elimination of the conventional deep shell portion of such timpani.

15 Claims, 4 Drawing Figures

Fig. 1
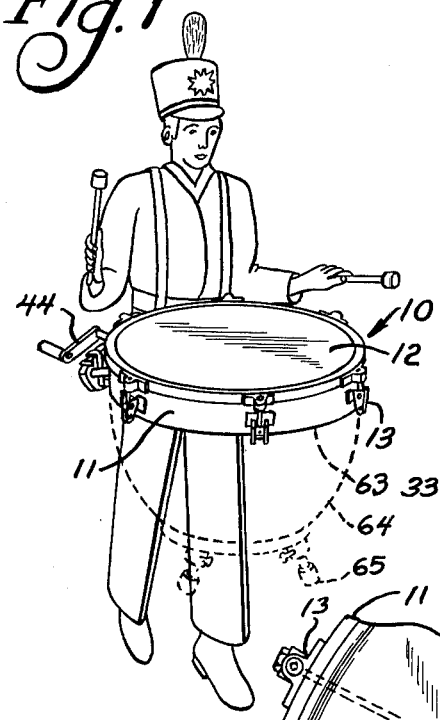
Fig. 3
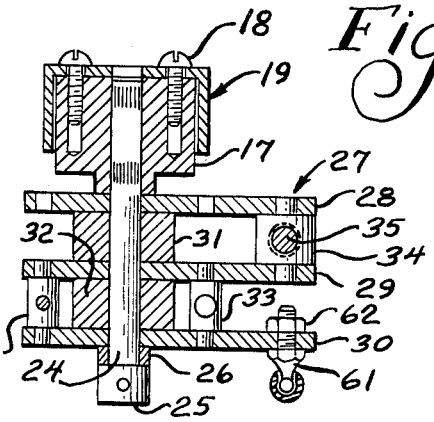
Fig. 2
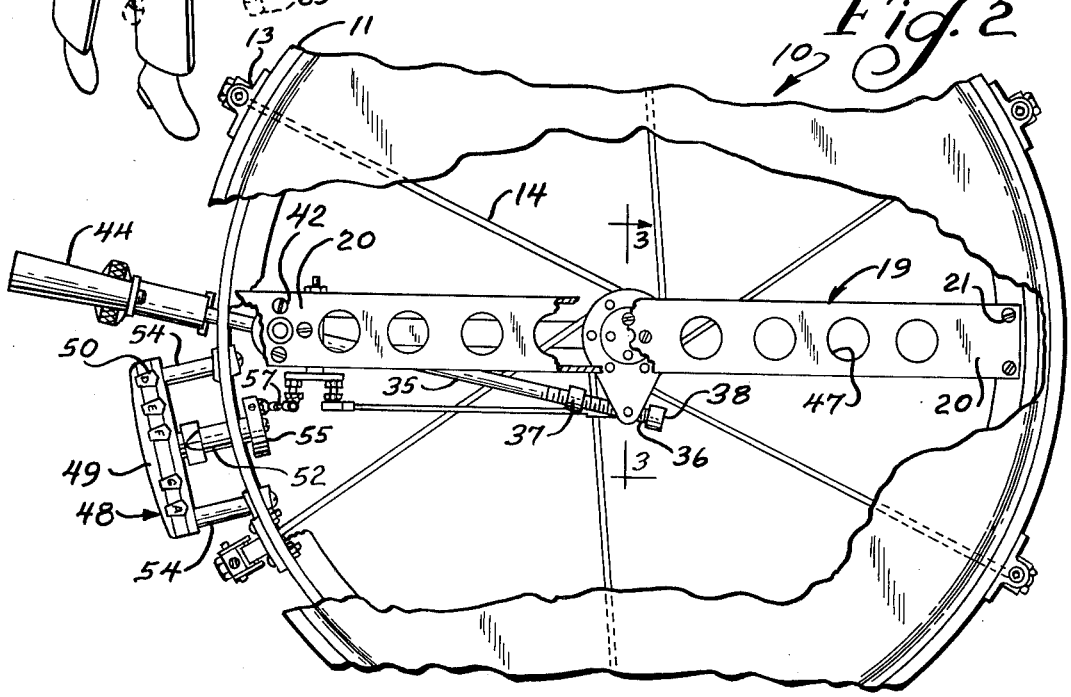
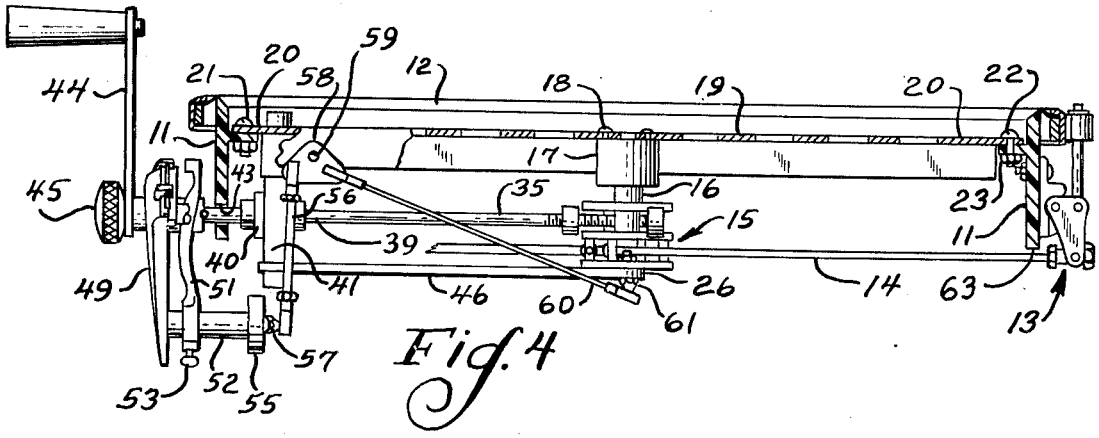
Fig. 4

MARCHING TIMPANI

BACKGROUND OF THE INVENTION

1. Field of the Invention

This invention relates to musical drums and in particular to marching timpani.

2. Description of the Prior Art

One form of drum comprises a tunable drum wherein tensioning devices are applied to the drum head to effect the pitch of the drum beat.

The use of kettle drums goes back many centuries. In approximately the 13th century, a small version of the kettle drum was arranged to be carried by the player as being fastened to a belt worn by the player. One application of such worn kettle drums was in connection with cavalry regiments.

More recently, mechanical tuning devices have been developed, including screw mechanisms. One substantial improvement in such mechanisms was made in the earlier part of the 19th century by providing means for simultaneously adjusting all of the tuning screws disposed around the circumference of the drum head. Other rapid tuning devices have been developed since that time for further improving the efficiency and rapidity of tuning changes. One important improvement in this respect was the use of a foot pedal permitting a substantial extension of the usefulness of such drums.

The conventional kettle drum utilizes a relatively deep shell with the tuning means extending downwardly either through the shell or about the shell. The control mechanism is conventionally mounted at the bottom of the shell and the tuning means includes manipulatable screws extending downwardly thereto from the counterhoop adjusting clamps.

SUMMARY OF THE INVENTION

The present invention comprehends an improved timpani which is adapted for marching use. More specifically, the present invention comprehends such a timpani construction comprising an annular shell defining an open upper end, the height of the shell being a fraction of the diameter thereof, a head secured across the upper end, a horizontal support extending across the shell below the upper end, a pivot device mounted to the support, a crank having a horizontal shaft and a handle at an outer end of the shaft accessible exteriorly adjacent the shell for manually rotating the shaft, means for pivoting the pivot device as the result of rotation of the shaft, and head adjusting means responsive to pivoting of the pivot device for adjustably tensioning the head.

Further more specifically, the improved head adjusting means may comprise a pivot device having a support portion disposed axially of the shell, a pivot shaft pivotally carried by the support for rotation about the shell axis, a radial arm on said pivot shaft defining a threaded through bore exposed radially from the shell axis, a drive shaft having a threaded portion threaded to the arm bore, means for causing axial fixed rotation of the drive shaft to effect threaded adjustment of the pivot shaft by the threaded portion of the drive shaft, and connecting means connecting the pivot device to the adjustable means for adjustably tensioning the head as an incident of the threaded adjustment of the pivot device.

Thus, the invention comprehends an improved compact marching timpani construction providing facilitated use as a marching timpani. The structure is extremely simple and economical while yet providing the highly desirable features discussed above.

BRIEF DESCRIPTION OF THE DRAWING

Other features and advantages of the invention will be apparent from the following description taken in connection with the accompanying drawing wherein:

FIG. 1 is a perspective view of a marching timpani embodying the invention worn by a player, a modified form of shell for use therein being illustrated in broken lines;

FIG. 2 is a fragmentary top plan view with portions broken away illustrating the construction thereof;

FIG. 3 is a fragmentary enlarged vertical section taken substantially along the line 3—3 of FIG. 2; and FIG. 4 is a fragmentary vertical diametric section thereof.

DESCRIPTION OF THE PREFERRED EMBODIMENT

In the exemplary embodiment of the invention as disclosed in the drawing, a marching timpani generally designated 10 comprises a flat disclike drum having an annular shell 11 and a head 12 secured across the shell by a plurality of adjustable tensioning clamps 13. As discussed above, the height of shell 11 may be a fraction of the diameter thereof. The tensioning clamps are of conventional construction well known to those skilled in the art and are adapted to be adjusted by means of longitudinal displacement of tensioning rods 14 connected one each to the different tensioning devices. The opposite end of each rod is connected to a connector, or pivoting device, generally designated 15, which is pivotally mounted on a depending shaft 16 secured by a connecting block 17 and suitable screws 18 to the midportion of a support channel 19 having its opposite ends 20 secured to inturned flanges 21 on the shell 11 by suitable means, such as bolts 22 and nuts 23.

As best seen in FIG. 3, connector 17 includes an axial pivot pin 24 having an enlarged lower end 25 carrying a support ring 26. Pivot connecting means generally designated 27 are pivotally mounted on the pin 24 and include an upper plate 28, a middle plate 29, and a lower plate 30. An annular spacer 31 is mounted on pivot pin 24 between plates 28 and 29, and a second annular spacer 32 is mounted on pivot pin 24 between plates 29 and 30.

Plate 29 is connected for pivotal movement on pivot pin 24 with plate 30 by a plurality of rod end pins 33 and plate 29 is connected for rotation on pivot pin 24 with plate 28 by a shaft end pin 34. Each of pins 33 and 34 is pivotally connected to the respective plates to provide a floating connection thereto.

Tensioning rods 14 are connected one each to the different rod end pins 33. A tensioning shaft 35 has a threaded end 36 threaded to pin 34. A pair of collars 37 and 38 are provided on threaded portion 36 to limit the threaded movement of the shaft through the pin 34 in opposite longitudinal directions.

The opposite end 39 of shaft 35 is journaled by means of suitable bearings 40 carried on a support 41 secured to channel end 20 by means of a plurality of screws 42. Shaft end 39 may extend outwardly through a suitable opening 43 in shell 11 and is provided at its distal end with a manually operable handle 44 for effecting rotation of the shaft 35 about its longitudinal axis, and thereby threading of the shaft through pin 34. Bearing 40 maintains the shaft against axial displacement and, thus, such threading effects a pivoting of the connecting means 27 about the pivot pin 24. As shown in FIG. 4, the handle may be secured to shaft end 39 by a suitable thumbscrew 45.

Thus, the tuning of the timpani may be effected by a simple manual operation of handle 44 by the player. As shown in FIG. 1, the handle is disposed in a convenient position to be readily manipulated by the player when desired. As the tensioning rods 14 extend generally parallel to the flat plane of head 12 and the tensioning shaft 35 similarly extends parallel thereto, the entire timpani may have a minimal height dimension and effectively comprise a disclike structure, as best seen in FIG. 1. Thus, to effect the desired tuning of the timpani, the player merely rotates handle 44 to provide the desired tension to the devices 13 by the pivoting of the connecting means 27 to which the tensioning rods 14 are connected so that all tensioning devices 13 are concurrently adjusted.

To provide improved stability of the connector 15, collar 26 may be provided at the end of a support bar 46 also connected to support 41. To minimize the weight of the timpani, the channel support 19 may be provided with a plurality of holes 47, as best seen in FIG. 2.

An automatic tuning gauge device may be provided in association with the timpani 10 providing further improved facilitated tuning of the head when desired. More specifically, as seen in FIGS. 2 and 3, the automatic tuning gauge device generally designated 48 comprises an indicator plate 49 having indicia 50 indicating different selectable pitches. An indicator arm 51 is secured to a pivot shaft 52 by suitable wingscrew 53. Plate 49 is secured to the shell by a plurality of standards 54 and pivotally carries shaft 52.

As best seen in FIG. 2, shaft 52 is provided at its distal end with an enlarged head 55 connected to a transfer shaft 56 by a universal connector 57.

Transfer shaft 56, in turn, is pivotally connected to a pivot plate 58 which is pivotally mounted to channel 19 by suitable pivot pins 59. Pivot plate 58 is further connected through a connecting rod 60 to a universal connector 61 secured to plate 30 as by nut 62.

Thus, disposition of selector arm 51 in any of the preselected dispositions identified by the indicia 50 may be effected by a corresponding rotation of pivot head 55 from plate 30 through the interconnecting means 56, 57, 58, 59, 60 and 61.

As best seen in FIGS. 1 and 2, the automatic tuning gauge device 48 is mounted to the shell closely adjacent handle 44 and while extending to the interior of the timpani under the shell, the lower end 63 of which, as seen in FIG. 4, is open, the effective downward extension of the device is effectively minimized so that the entire timpani remains essentially a disclike structure having effectively minimum height for facilitated use by a marching drummer. As shown in FIG. 1 in broken lines, the shell may alternatively comprise a bowl-shaped shell having a conventional hollow bottom 64 provided with floor-engaging supports 65.

Thus, the present invention comprehends an improved marching timpani which eliminates the deep kettle construction and vertical reinforcing struts which have been considered indispensable in marching bands heretofore. The present invention utilizes extremely simple and economical structure arranged in a substantial planar configuration providing a highly rigid configuration permitting desirable accurate tuning of the timpani head while yet eliminating the costly and relatively heavy construction of the conventional marching timpani.

The foregoing disclosure of specific embodiments is illustrative of the broad inventive concepts comprehended by the invention.

I claim:

1. A marching timpani comprising:
- an annular shell defining an open upper end, the height of said shell being a fraction of the diameter thereof;
- a head secured across said upper end;
- a horizontal support extending across said shell below said upper end;
- pivot means mounted to said support coaxially of said shell;
- a crank having a horizontal shaft and a handle at an outer end of the shaft accessible exteriorly adjacent said shell for manually rotating said shaft;
- means for pivoting said pivot means as the result of rotation of said shaft; and
- head adjusting means responsive to pivoting of said pivot means for adjustably tensioning said head.

2. The marching timpani of claim 1 wherein said shell is a circularly cylindrical tube.

3. The marching timpani of claim 1 wherein said shell defines an open lower end.

4. The marching timpani of claim 1 wherein said shell defines an open lower end and said pivot means depends from said support to below said lower end.

5. The marching timpani of claim 1 wherein said means for pivoting the pivot means comprises threaded connecting means on said shaft and pivot means.

6. The marching timpani of claim 1 wherein said shell defines an open lower end and said shaft is disposed adjacent said lower end.

7. The marching timpani of claim 1 including means for supporting said crank by said support.

8. The marching timpani of claim 1 wherein said shaft extends through said shell.

9. The marching timpani of claim 1 wherein said shell defines an open lower end, said pivot means extends downwardly to below said lower open end, said head adjusting means includes adjusting elements extending radially outwardly from said pivot means below said shell and means mounted to said shell operated by said adjusting elements for adjustably tensioning said head.

10. In a marching timpani having a shell defining a vertical axis, a head across the shell, and adjustable means on the shell for adjustably tensioning the head, improved means for adjusting said adjustable means comprising:
- a support extending diametrically of the shell and having a portion disposed at the axis of the shell;
- a pivot shaft carried by said support portion coaxially of said shell axis;
- pivot means including a radial arm pivotally carried on said pivot shaft and defining a threaded through bore spaced radially from said shell axis;
- a drive shaft having a threaded portion threaded to said radial arm bore;
- means for causing axially fixed rotation of said drive shaft to effect adjustable pivoting of said radial arm by the threaded engagement of said drive shaft threaded portion with said radial arm; and
- connecting means connecting said pivot means to said adjustable means for adjustably tensioning said head as an incident of said threaded adjustable pivoting of said radial arm of the pivot means.

11. The marching timpani of claim 10 wherein said support extends closely subjacent said head.

12. The marching timpani of claim 10 wherein said connecting means comprises rods extending from said pivot means parallel to said head to said adjustable means.

13. The marching timpani of claim 10 wherein said drive shaft comprises a rod extending from said pivot means radial arm outwardly through said shell parallel to said head.

14. The marching timpani of claim 10 wherein said drive shaft comprises a rod extending from said pivot means radial arm outwardly through said shell parallel to said head, said connecting means comprising rods extending from said pivot means parallel to said head to said adjustable means.

15. The marching timpani of claim 10 wherein means are provided for selectively indicating the tone produced by adjustment of said pivot means as a result of the threaded adjustment thereof by said drive shaft.

* * * * *